United States Patent [19]

Ritter et al.

[11] 4,143,634

[45] Mar. 13, 1979

[54] RPM GOVERNOR FOR FUEL INJECTION ENGINES

[75] Inventors: Ernst Ritter; Reinhard Schwartz, both of Stuttgart, Fed. Rep. of Germany

[73] Assignee: Robert Bosch GmbH, Stuttgart, Fed. Rep. of Germany

[21] Appl. No.: 836,183

[22] Filed: Sep. 23, 1977

[30] Foreign Application Priority Data

Oct. 6, 1976 [DE] Fed. Rep. of Germany ..... 2644994

[51] Int. Cl.[2] ..... F02D 1/04

[52] U.S. Cl. ..... 123/179 L; 123/139 ST; 123/140 J

[58] Field of Search ..... 123/140 R, 140 MC, 140 J, 123/179 L, 139 ST

[56] References Cited

U.S. PATENT DOCUMENTS

| | | | |
|---|---|---|---|
| 3,577,908 | 5/1971 | Staudt | 123/140 J |
| 3,924,594 | 12/1975 | Aoki | 123/140 MC |

FOREIGN PATENT DOCUMENTS

| | | | |
|---|---|---|---|
| 2148762 | 4/1973 | Fed. Rep. of Germany | 123/140 J |
| 2224755 | 1/1974 | Fed. Rep. of Germany | 123/140 R |

*Primary Examiner*—Alan Cohan

*Attorney, Agent, or Firm*—Edwin E. Greigg

[57] ABSTRACT

An rpm governor for fuel injection engines whose function is to raise the idle rpm for a predetermined time period while the engine is cold in order to guarantee a clean idle running cycle of the engine. The rpm governor includes a compensating device having a thermostat which is designed to engage an idling spring and whose duration of engagement is determined by a heating device located on the thermostat. When the engine is cold, the tension in the spring is raised by the compensating device, thus effecting a higher rpm level, which rpm level is later reduced to normal idle when the governor has reached an operational temperature upon the passage of a predetermined period after cold starting.

7 Claims, 2 Drawing Figures

RPM GOVERNOR FOR FUEL INJECTION ENGINES

BACKGROUND OF THE INVENTION

The invention relates to rpm governors for fuel injected internal combustion engines having a regulating member which adjusts a main regulating spring, whose regulating movements can be transferred to the fuel supply rate adjusting member of the fuel injection system, and having a compensating device, which: (1) is dependent on the operating temperature of the regulator, (2) changes the tension in the idling control spring, (3) engages the idling spring, and (4) has a thermostat.

A governor of this general type is already known (DT -OS No. 2,224,755) wherein a thermostat comprised of a bimetallic spring acts on the idling control spring to increase the idle rpm after cold starting. The bimetallic spring mounted on the force transfer lever so as to transfer the tension of the main control spring to the control member, is located within the rpm governor. This bimetallic spring does not contract to reduce the then-elevated tension in the idling control spring until the interior of the governor, or the lubricating oil thereof, is heated to the normal operating temperature of the engine. While the engine heats to operating temperature relatively slowly, the higher friction in a cold engine decreases much sooner. Though there is no longer a requirement for it, the higher rpm level will be maintained until the engine is fully warm, and this will lead to excessive fuel consumption.

OBJECTS AND SUMMARY OF THE INVENTION

It is a primary object of the invention to provide an rpm governor wherein the tension in the idling control spring, which is increased for cold starting, is decreased to allow the spring to return to its normal operational position within a predetermined time.

Another object of the invention is to reduce the electric current consumption of the compensating device by the use of a temperature-dependent resistor placed in the electrical circuit of the heating device.

A further object of the invention is to provide that, if the engine is stopped for only a short time, the heating device is not re-activated when the engine is restarted unless the temperature in the interior of the governor has fallen below a suitable base value.

A still further object of the invention is to provide a compact rpm governor of reliable construction which does not overload the thermostat contained therein.

The invention will be better understood as well as further objects and advantages thereof become more apparent from the ensuing detailed description taken in conjunction with the drawings.

BRIEF DESCRIPTION OF THE DRAWINGS

Two exemplary embodiments of the invention are described in detail in the following description by reference to the drawings, in which.

DESCRIPTION OF THE PREFERRED EMBODIMENTS

Figure 1:
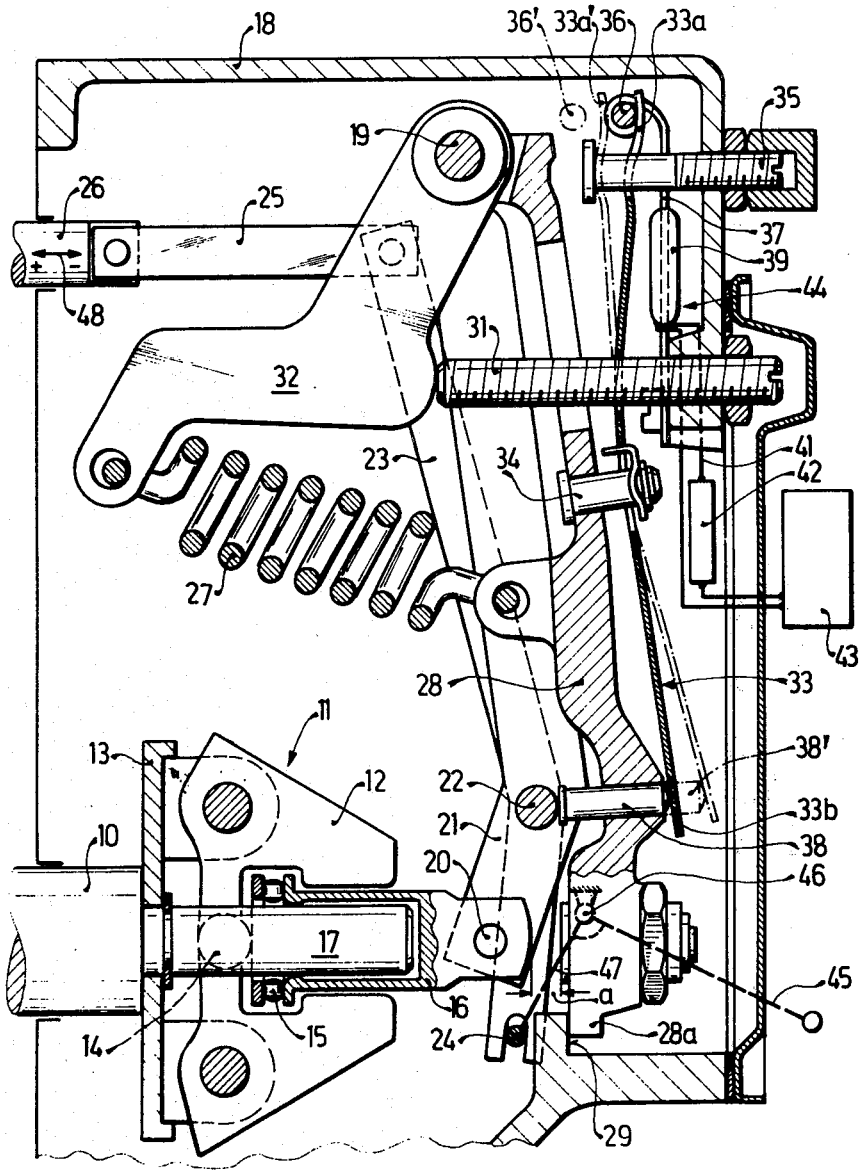
FIG. 1 is a sectional view through the first embodiment.

Turning now to the first embodiment of this invention shown in FIG. 1, a common flyweight regulator 11 is attached to the cam shaft 10 of a fuel injection pump, (not shown) with the fly weights 12 being rotatably mounted on a carrier 13, which is connected with the cam shaft 10. The flyweights 12 transfer their centrifugally-dependent adjusting forces to a regulating sleeve 16, which serves as the regulating member, such transfer being achieved through the medium of the pressure arms 14 and a pressure bearing 15. The regulating sleeve 16 is supported on a cylindrical pin 17 integral with the cam shaft 10, at its free end it is connected by means of a support pin 20 with a rotatable guide lever 21 the upper terminal end portion of which is affixed to a support pin 19, which is attached in the governor housing 18.

The guide lever 21 is provided with support pin 22, arranged to serve as the rotating support of a regulating lever 23, which is formed as a two-armed intermediate lever. This lever is rotatable about a point of rotation such as 24 and thereby transfers the control movements of the regulating sleeve 16, by means of a side bar 25, to the regulating rod 26 which serves as the supply rate adjusting member of the fuel injection pump.

The support pin 19 serves also as a rotation support for a force transfer lever 28, which is under the return force of a main control spring 27. The terminal end **28*a* of the force transfer lever 28 is juxtaposed opposite the support pin 19 against a stop means 29** in the housing as shown.

The present governor relates to a so-called idling and end rpm governor in which the pretensed main control spring 27 is arranged to determine the end rpm by means of an adjusting screw 31 and a compensating lever 32, which is pivotally supported on the pin 19. In contrast, the idling rpm is controlled by an idling control spring 33, which (1) is formed as a flat spring, (2) is attached with a center bearing 34 to the force transfer lever 28, and (3) arranged to have its bifurcated end portion **33*a* straddle a positioning screw 35 and rest against an actuating member 36, of a thermostat 37, which is formed as a bimetallic spring. The positioning screw 35 serves as a first resisting support and the actuating member 36 serves as a momentary second resisting support. The rod-shaped actuating member 36, which is attached to the bimetallic spring 37, remains in the shown position, which it assumes when the engine is cold and applies tension to the idling control spring 33 to regulate a higher idling rpm. The bimetallic spring is so arranged, that when the engine is warm, i.e. is above a predetermined operating temperature, it moves the actuating member 36 in the direction of the position 36' shown as a broken line, and because of the loose coupling between the actuating member 36 and the idling control spring 33 the bifurcated end 33*a* of the idling control spring 33 is brought into abutment against an enlarged headed portion of the first resisting support 35, as shown and does not move farther. This position determines the normal, warm tension of the idling control spring 33 and thereby determines the regulating characteristics in the idling control. The other or lower end 33*b* of the idling control spring 33 which is opposite to the first resisting support 35, is coupled with the support pin 22 by a pressure rod 38, which is supported on the force transfer lever 28**, and is moved into a second position 38', shown by the broken line, by movement of the regulating sleeve through idling stroke "a," in which position the lower end 33*b* of the idling control spring 33 assumes a shifted position, also shown as a broken line.

The bimetallic spring 37 is provided with a heating device 39, connected to an electrical circuit 41 provided with a positive temperature-coefficient resistor 42 included as a cold conductor. The remaining part of the related circuit, shown as 43, contains the current supply, related switches and a means for limiting the duration of heating of the heating device 39. Considered as one unit, the thermostat 37, the heating device 39, the temperature-dependent resistor 42 and the circuit 43 are designated as the compensating device 44, which, according to the invention, effects change in the tension force of the idling control spring 33, over a period of time, dependent upon the operating temperature of the governor. The functional characteristics of this compensating device 44 are further explained hereinafter in more detail.

The thermostat 37 and the resisting support 35 of the idling control spring 33 are attached to the governor housing 18 in an especially advantageous manner, requiring no movable, current-supplying parts. Further, it is particularly advantageous that the first resisting support 35 of the idling control spring 33 be disposed as closely as possible to the rotating support 19 of the force transfer lever 28; thus, due to this juxtaposition, during the deregulation of the governor, wherein the force transfer lever 28 performs a counter-clockwise rotational movement, a very small relative movement is produced between the end 33*a* of the idling control lever 33 and the first resisting support 35 or the second resisting support 36.

In an idling and terminal rpm governor, following the invention, which operates as an injection regulator, a fuel supply rate adjustment, which is independent of the position of the regulating sleeve 16, can occur, along with a corresponding shift of the regulating rod 26 through a schematically illustrated adjusting lever 45 which lever is so connected to a support 46 in the housing 18 as to rotate an inner control lever 47, which is connected to the point of rotation 24. If the adjusting lever 45 and the control lever 47, which are coupled together as an angle lever, should be moved, for example, clockwise, then the point of rotation 24 moves, as can be seen in FIG. 1, to the left, thus rotating the regulating lever 23 about its support pin 22, also in a clockwise direction, moving the regulating rod, by means of the side bar 25, to a position of decreased fuel supply rate (the negative direction, according to the arrow 48). A counter-clockwise rotation of the adjusting lever 45 produces a supply rate increase (positive directional movement, according to the arrow 48).

Figure 2:
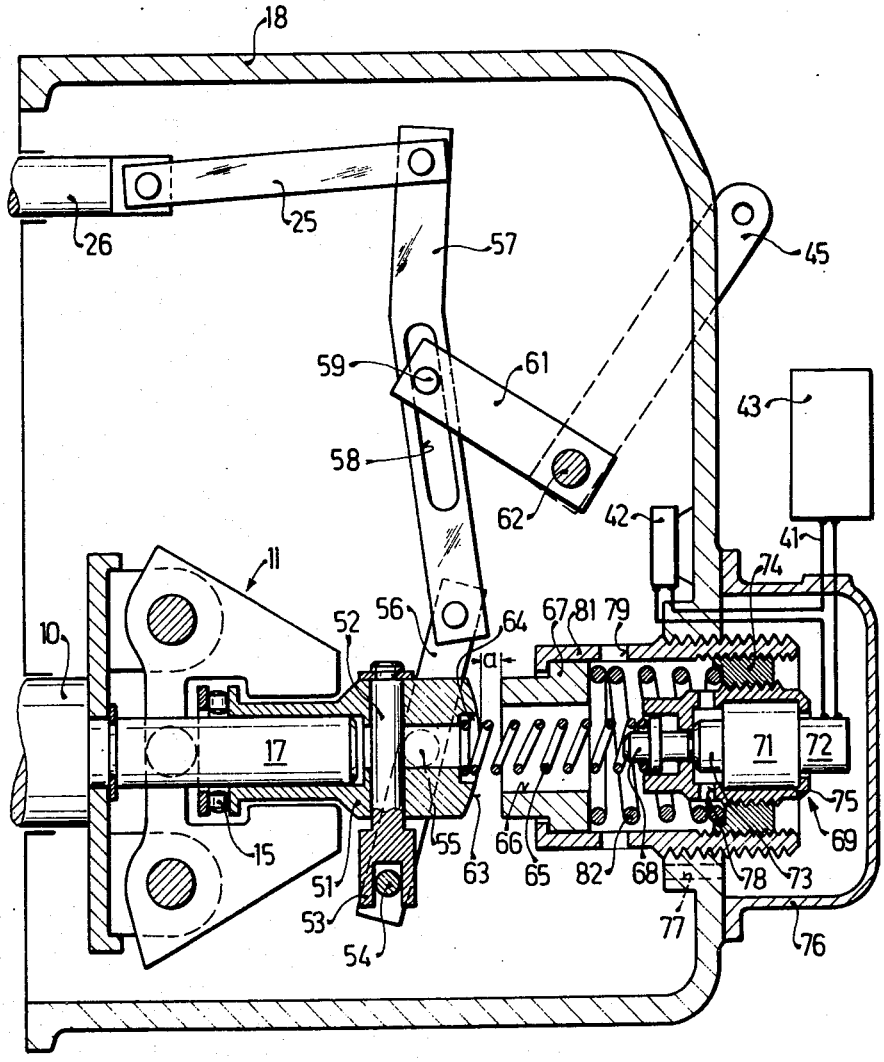
FIG. 2 is a sectional view through the second embodiment.

The second embodiment, shown in FIG. 2, also discloses an idling and maximum rpm governor, however, the regulating springs are arranged on extensions of the regulating member axle. (Similar parts are provided with the same reference numerals used in FIG. 1).

On the cylindrical pin 17 integral with the cam shaft 10, there are provided a fly weight regulator 11, a slidable regulating sleeve 51 which is further provided with a bolt having a forked end 53. The forked end is arranged to encompass, free of play, an offstanding pin 54 that is associated with a lever 56 rotatably mounted in a support pin 55, which is positively fixed to the housing. On its opposite extremity from the rod 54, the lever 56 is pivotally linked to a regulating lever 57 which serves as an intermediate rocker arm lever having a guide slit 58 which slidably engages a pin 59 of an adjusting member 61, which is connected as a crank with the external adjustment lever 45 via a shaft 62 that is positively mounted to the governor housing 18. The regulating lever 57 is further coupled with the regulating rod 26 via the side bar 25, in the same manner as disclosed for regulating lever 23 in FIG. 1.

On the face 63 of the regulating sleeve 51 in the extremity opposite to the pressure bearing 15, a compression spring 65, which operates as the idling control spring, is arranged to be received an axial depression 64. This compression spring 65 extends through an annulus 66 provided in a flanged sheath 67 and is disposed against a shoulder on bolt-shaped yieldable support 68. The yieldable support 68 forms a portion of a compensating device 69, which includes a thermostat 71 with a heating device 72, which is connected to a circuit 43 that contains a temperature-dependent (PTC) resistor 42, included as a cold conductor in a circuit 41, all elements being comparable to those identified in FIG. 1. The thermostat 71 has an actuating rod 73, which takes the position shown, when the engine is cold, thus preloading the idling control spring 65 via the resisting support 68, in order to increase idling rpm, comparable to the action of a choke. The thermostat 71 and the yieldable support 68 are encompassed within a housing 75, which is threaded into a screw ring 74. The entire compensating device 69 is enclosed by a cover 76, which communicates with the governor housing 18 through bores 77, which, with bores 78 in the housing 75 and bores 79 in a bushing 81, allow oil in the governor housing access to the thermostat 71. The bushing 81 is threaded into the governor housing 18, as an axial extension of the regulating sleeve 51 and the cam shaft 10, and further contains, in addition to the above-described parts, the main control spring 82, which is seated at one extremity against the support sheath 67 and at the other extremity against the screw ring 74.

Hereinafter, the method of operation of the rpm governor according to the invention is explained with reference to the embodiments illustrated in FIGS. 1 and 2, with particular attention being given to the compensating device, 44 or 69.

In the first embodiment, FIG. 1, the bimetallic spring 37 remains in the position shown while the engine is cold, and the actuating member 36 has pulled the end 33*a* of the idling control spring 33 away from its first resisting support 35 to increase its tension, whereby the actuating member 36 serves as a momentary second resisting support. The elevated tension in the idling control spring 33 is transferred to the support pin 22 via the pressure rod 38, and thereby to the regulating sleeve 16 via the guide lever 21. Thus, the regulating sleeve 16 must work against an increased force in the idling control spring 33 through its idling stroke "a," so that the engine runs with a correspondingly higher idle rpm.

The increased tension in the idling control spring 33 is maintained by the circuit 43 of the heating device 39 only for a predetermined operational period. Thus, the heating of the bimetallic spring 37 by the heating device 39 tends to move the actuating member 36 in the direction of the position 36', so that the end 33*a* shifts, for example, after a heating period of about three minutes, to a position against its first resisting support 35; in addition, further heating of the bimetallic spring 37, and therefore the actuating member 36, can move it farther into the position shown as 36'. The PTC-resistor 42 is so disposed that the current supply to the heating device 39 is interrupted, or lowered to a minimal value, when the interior of the governor is heated to an operational temperature above a predetermined level. In this manner, the heating device 39 is turned off and the current use by the compensating device 44 is curtailed.

The compensating device 69 of the second embodiment, FIG. 2, operates in an analogous manner, the primary distinction being that the thermostat 71 projects its actuating rod 73 directly against the yieldable support 68 of the idling control spring 65. The yieldable support 68 is shown in its cold-start position, in which position the actuating rod 73 of the thermostat 71 has pushed the yieldable support 68 from its rest position (shown in FIG. 2) thus increasing the tension in the idling control spring 65. After starting the thermostat 71, which may be, for example, an elastic member, is heated as with the first embodiment, and the actuating rod 73 moves to the right to assume the position shown in FIG. 2, whereupon the yieldable support 68 follows this movement, until it abuts the housing 75. The heating period is determined by the circuit 43 and, when the operational temperature of the governor is reached, the current supply to the heating device 72 is interrupted or reduced to a minimum by the previously-described functioning of the temperature-dependent resistor 42, which is formed as a cold conductor.

What is claimed is:

1. An rpm governor for fuel injection internal combustion engines, having a housing, an rpm-dependent regulating member including at least one idling and one main control spring associated with at least one intermediate lever adapted to influence a supply rate adjusting member of the fuel injection device, and further including a temperature dependent correcting device that is adapted to change the tension of the idling control spring and a thermostat associated with said idling spring, the further improvement wherein said thermostat is provided with a heating means which controls the operating period of the correcting device.

2. An rpm governor according to claim 1, further wherein a temperature-dependent resistor is included in the circuit of the heating means.

3. An rpm governor according to claim 2, further wherein said temperature-dependent resistor is formed as a PTC-resistor.

4. An rpm governor according to claim 1, further wherein said correcting device engages a first support for said idling control spring, whereby said first support assumes a shifted position before starting and when the engine is cold to thereby increase the tension of said idling control spring.

5. An rpm governor according to claim 1, in which said idling control spring is embodied as a leaf spring, one end of which is supported by support means and the other end of which is engaged by said governor member and further including a thermostat which includes an actuating member that engages one end of said idle control spring in the vicinity of a stop means and is further arranged to serve as a temporary secondary stop for said idle control spring in the sense of lifting said idle control spring from its stop means when the engine is cold.

6. An rpm governor according to claim 5, further wherein said actuating member is coupled with said idling control spring by a lost motion coupling, whereby during a temperature increase after said last named spring rests against its stop means said actuating member can move away from said spring.

7. An rpm governor according to claim 5, further wherein a force transfer lever that includes a pivot point is affixed to a rotational support in said housing, and is activated by said control member, with said stop means that cooperate with said idling control spring being arranged in close proximity to the rotational support of said force transfer lever and that the first of said stop means and said thermostat are attached to said governor housing.

* * * * *